US006058758A

United States Patent [19]

Wymann

[11] Patent Number: 6,058,758

[45] Date of Patent: May 9, 2000

[54] PRESS WITH A HYDRAULIC PLATE

[75] Inventor: Hans Wymann, Lyss, Switzerland

[73] Assignee: Feintool International Holding, Lyss, Switzerland

[21] Appl. No.: 09/155,194

[22] PCT Filed: Mar. 14, 1997

[86] PCT No.: PCT/EP97/01303

§ 371 Date: Sep. 23, 1998

§ 102(e) Date: Sep. 23, 1998

[87] PCT Pub. No.: WO97/35710

PCT Pub. Date: Oct. 2, 1997

[30] Foreign Application Priority Data

Mar. 27, 1996 [DE] Germany ..... 196 12 242

[51] Int. Cl.[7] ..... B21D 37/04; B21D 37/14

[52] U.S. Cl. ..... 72/448; 83/571; 72/470

[58] Field of Search ..... 72/446, 448, 470, 72/444; 83/563, 571

[56] References Cited

U.S. PATENT DOCUMENTS

| | | | |
|---|---|---|---|
| 3,610,021 | 10/1971 | Hopper | 72/446 |
| 3,848,494 | 11/1974 | Gargrave | 83/563 |
| 3,881,343 | 5/1975 | Ducate | 72/446 |
| 4,151,736 | 5/1979 | Quaas | 72/446 |
| 4,258,620 | 3/1981 | Sallander | 72/446 |
| 4,698,894 | 10/1987 | Lingaraju | 72/446 |

FOREIGN PATENT DOCUMENTS

| | | |
|---|---|---|
| 201456 | 11/1986 | European Pat. Off. . |
| 4343336 | 6/1995 | Germany . |

*Primary Examiner*—Daniel C. Crane
*Attorney, Agent, or Firm*—Bachman & LaPointe, P.C.

[57] ABSTRACT

The invention concerns a press, in particular, a precision blanking press, with a slide (1) and a press lower part (3) associated with the slide, a tool (17) being located between the slide (1) and the press lower part (3). According to the invention, a hydraulic plate (9, 10) is disposed between an upper tool and the slide (1) and/or a lower tool and the press lower part (3).

9 Claims, 7 Drawing Sheets

PRESS WITH A HYDRAULIC PLATE

This application is a 371 of PCT/EP97/01303, filed Mar. 14, 1997.

The invention relates to a press, in particular a precision blanking press, with a press upper part and a press lower part associated with the press upper part, a tool being located between the press upper part and press lower part and a hydraulic plate being arranged between an upper tool and the press upper part and/or a lower tool and the press lower part.

Various forms and designs of presses are commercially available. As a rule, a press punches out a workpiece from a workpiece strip, for example, and the corresponding tool machines it in the press, for example folds it or the like. During the machining of the workpiece, a plurality of tool elements interact, and as a rule each of these is subjected to a specific pressure. As a function of the pressures set there is an interaction of the tool elements in order to machine the workpiece.

This applies especially also to so-called precision blanking devices in which the strips to be punched or the blanks are clamped between a blanking plate and a press plate and a blanking die and a pressure pad, which then move relative to one another. A corresponding precision blanking device is described, for example, in European Patent Application 85 981 05 31.5. In said publication it is apparent that the hydraulic devices for both sides of the press, i.e. for the upper and lower tools are extraordinarily complicated and are fixed for each press, i.e. cannot be changed.

A press of the above-mentioned type is known from DE 43 43 336 A1 as a hydraulic deep drawing device.

The present invention is based on the object of developing a press of the above-mentioned type in which the design of the press and the control, in particular of the activity of the tools, is significantly simplified and configured in a very variable fashion.

This object is achieved by virtue of the fact that the upper and lower hydraulic plates are connected by means of built-in supports to form a piece of additional hydraulic equipment.

Consequently, the upper and lower hydraulic plates are combined to form a unit which can be inserted between, for example, a slide and the press lower part of the press. By means of the built-in supports, the upper and lower hydraulic plates are held apart, so that the hydraulic plates can each be secured separately to the slide and/or press lower part. In order to remove the built-in supports, the slide then merely needs to complete a travel movement, causing the built-in supports to be released.

Furthermore, there is also provision to connect a lower and an upper tool plate to form a tool packet, so that this tool packet can also be handled as a unit. This tool packet is placed as a unit between the two hydraulic plates, clamped tight, and the built-in supports are released by a travel movement of the slide. This means that not only the entire hydraulic device of the press, insofar as it affects the tool, but also the tool device itself can be handled very flexibly. An existing tool or tool module can be exchanged at any time for a different tool packet with other tools. Basically, merely the base frame and the travel device for the slide always remain the same. All the other parts of the press can be exchanged and replaced with other ones.

The chosen hydraulic plate has the advantage that the entire hydraulic system for controlling the tool is no longer fixed in the press itself but instead is separate from the actual press. The hydraulic plate can be exchanged at any time and replaced with another hydraulic plate with a different hydraulic control system. In the preferred exemplary embodiment there is even provision that the hydraulic plate always remains unchanged while the actual hydraulic units can be inserted separately into the hydraulic plate and therefore also exchanged separately. Depending on the working method which is to be carried out on the corresponding press, the hydraulic units can be exchanged and replaced with suitable units. Consideration has been given particularly to the possibility of a plurality of hydraulic units being accommodated one next to the other in the hydraulic plate, with the result that a plurality of work steps can be completed one after the other in a press. In this way, it is possible to machine a workpiece in this press similarly to a multiple tool or a multiple press. As a result, the entire work procedures are made significantly simpler and easier.

A hydraulic unit preferably has a working cylinder in which a working piston is arranged. This working piston is pressurized by an appropriate pressure medium or else a mechanical spring, for example; a controllable and adjustable pressure medium being, however, preferred. As a rule, hydraulic oil is suitable here, but, in particular, nitrogen is also conceivable.

In order to feed in the pressure medium, a plug-in pipe is provided which can be inserted into the hydraulic plate and forms a connection between, for example, a hydraulic assembly and the working cylinder. The hydraulic assembly itself may, in turn, be mobile so that it is independent of the press. When nitrogen is used, the system is of similar design, but there are then nitrogen containers located outside the plate.

Quick-release clamping devices, such as are described in European Patent Application 86 81 01 76.7, are preferably used to secure the hydraulic plate to the press upper part and or the press lower part easily and quickly. As a result, the hydraulic plates can be exchanged very quickly. In addition, there is provision to manufacture the hydraulic plates from aluminum, as a result of which there is considerable saving in weight.

It is particularly preferred that the upper and lower hydraulic plates be connected to form one unit which can be inserted between, for example, a slide and the press lower part of the press. By means of corresponding built-in supports the upper and lower hydraulic plates are held apart so that the hydraulic plates can each be secured separately to the slide and/or press lower part. In order to remove the built-in supports, the slide then merely needs to complete a travel movement, causing the built-in supports to be released.

Furthermore, there is also provision to connect a lower and an upper tool plate to a tool packet so that this tool packet can also be handled as a unit. This tool packet is placed as a unit between the two hydraulic plates, clamped tight, and released by a travel movement of the slide of the built-in supports. This means that not only the entire hydraulic device of the press, insofar as it affects the tool, but also the tool device itself can be handled very flexibly. A tool which is present or a tool module can be exchanged at an time for a different tool packet with other tools. Basically, merely the base frame and the travel device for the slide always remain the same. All the other parts of the press can be exchanged and replaced with other ones.

Further advantages, features and details of the invention emerge from the following description of preferred exemplary embodiments and with reference to the drawing, in which FIG. 1 shows a schematically illustrated side view of a press according to the invention;

Figure 9:
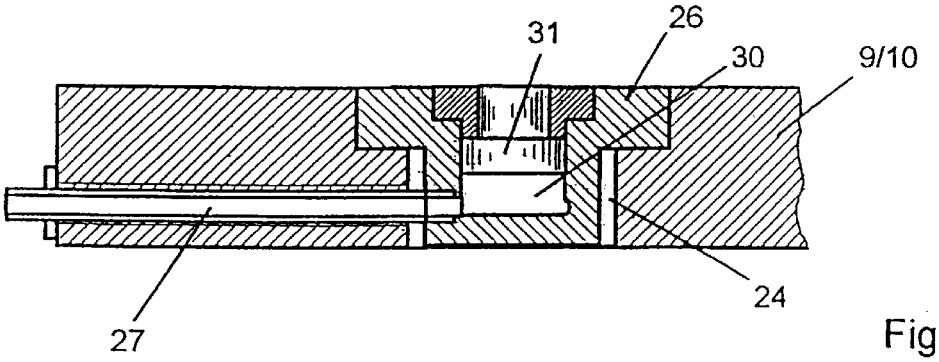
Figure 10:
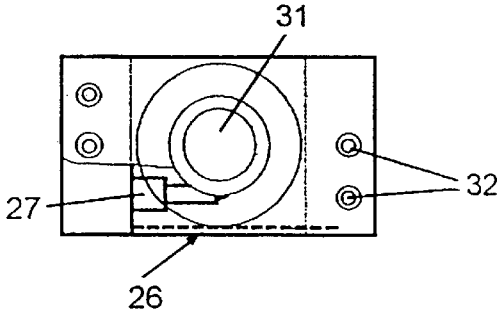
Figure 11:
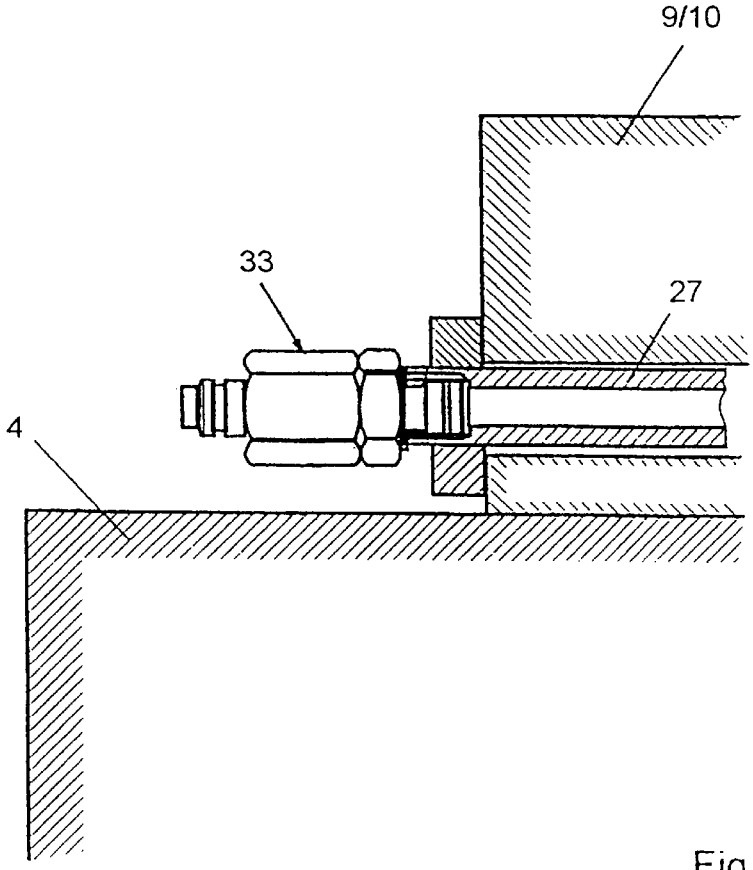
Figure 12:
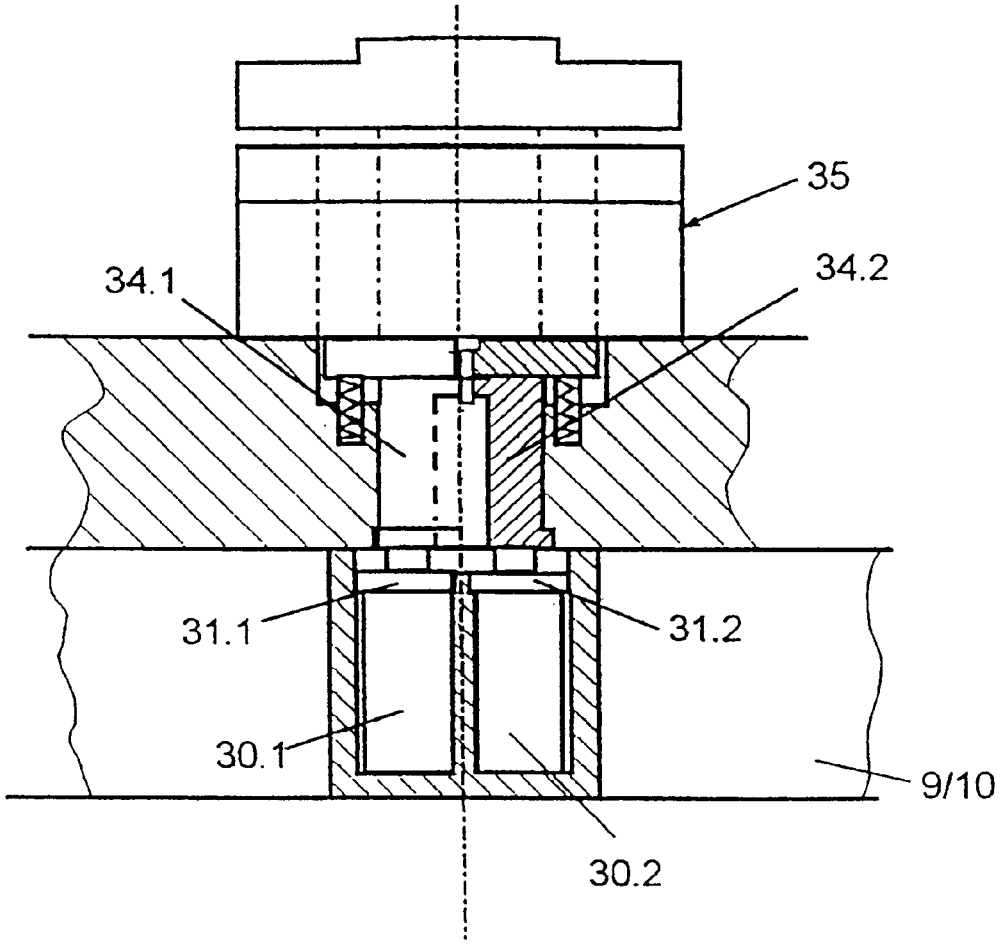
Figure 14:
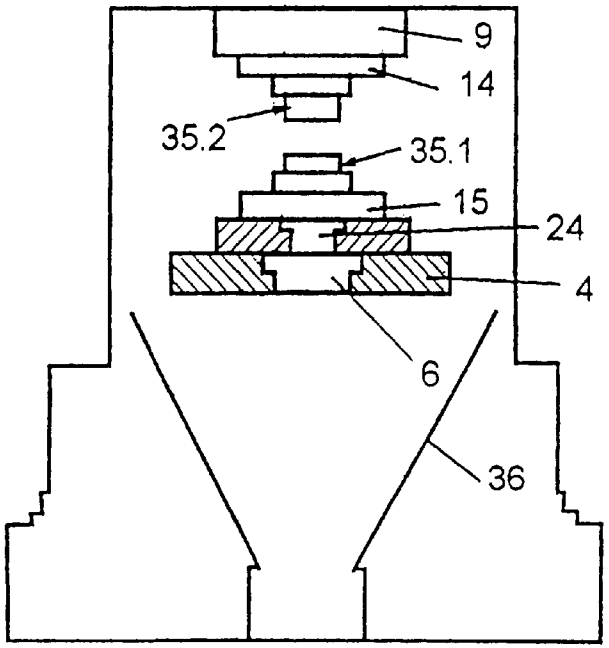
Figure 13:
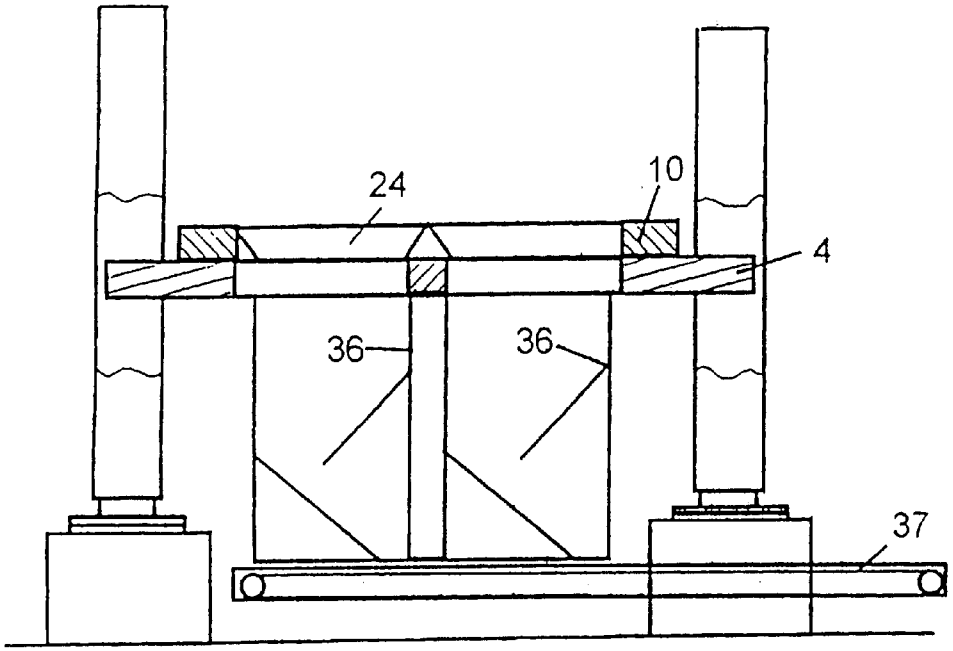

FIGS. 8*a–d* shows a schematic illustration of the possible arrangements of hydraulic units or nitrogen units within hydraulic plates;

FIG. 9 shows a cross section through a hydraulic unit or a nitrogen unit in the installed position in a hydraulic plate;

FIG. 10 shows a plan view of the hydraulic unit in accordance with FIG. 9;

FIG. 11 shows a cross section through a safety coupling in the installed position, illustrated in an enlarged view;

FIG. 12 shows a cross section through a further exemplary embodiment of a nitrogen unit in the position of use;

FIG. 13 shows a schematic side view of a press according to the invention;

FIG. 14 shows the end view of the press in accordance with FIG. 13.

Figure 1:
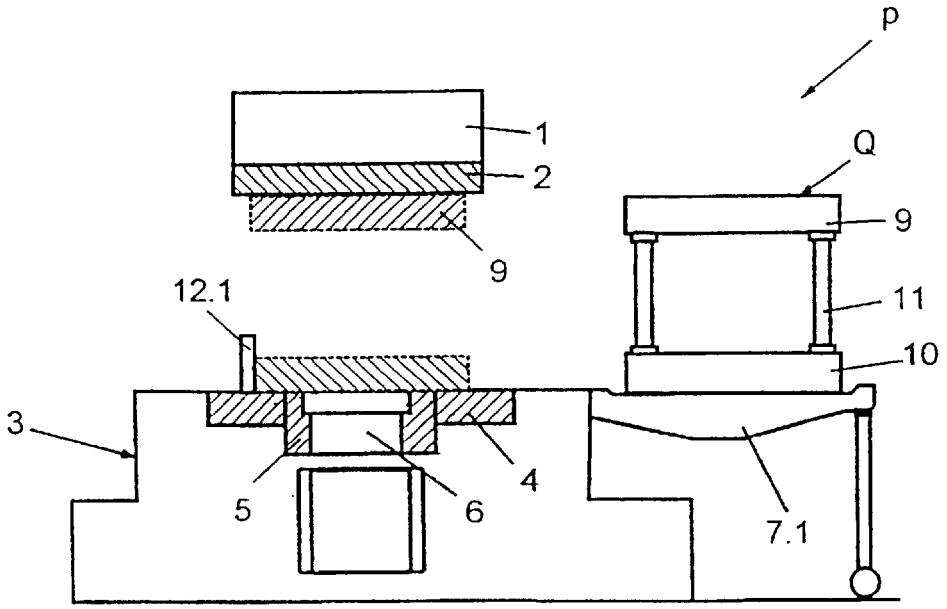

FIG. 1 represents a press P in a schematic view, with only those elements which are important for the present invention. This includes essentially a slide 1 (press upper part) with which the press travel is carried out. On the slide 1 there is a clamping-on plate 2 which may, moreover, also be an integrated component of the slide itself.

Opposite the slide 1 there is a press lower part 3 into which a table clamping surface 4 is let. Provided in the table clamping surface 4 is an insert 5 which has a central opening 6 through which a punched or precision blanked product or a punching can drop down.

Secured to the side of the press lower part 3 are two supporting brackets 7.1 and 7.2 which each have a race 8 on which a piece of additional hydraulic equipment Q according to the invention is seated. Said equipment is composed of an upper hydraulic plate 9 and a lower hydraulic plate 10 which are kept at a distance from one another by means of four built-in supports 11.

In order to insert the piece of additional hydraulic equipment Q into the press P, the piece of additional hydraulic equipment Q is moved on the race 8 into the region between the slide 1 and/or clamping-on plate 2 and press lower part 3 and/or table clamping surface 4. Here, the upper hydraulic plate 9 and the lower hydraulic plate 10 are secured to the clamping-on plates 2 and 4, which may be effected, for example, by means of a quick-release clamping device such as is described in European Patent Application 86 81 01 76.7. As soon as the upper hydraulic plate 9 and the lower hydraulic plate 10 are secured, the slide 1 moves upward so that the built-in supports 11 are released. They are removed so that the space between the upper hydraulic plate 9 and lower hydraulic plate 10 is then free for the insertion of a tool packet.

Figure 2:
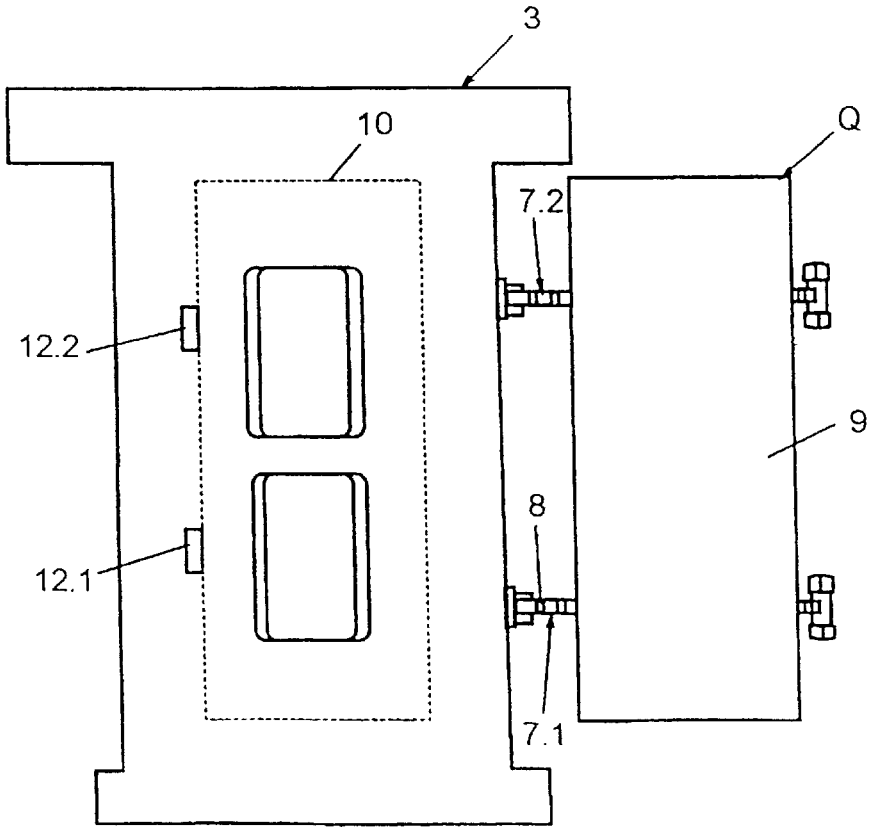
FIG. 2 shows a plan view of the press in accordance with FIG. 1 without a press upper part.
Figure 3:
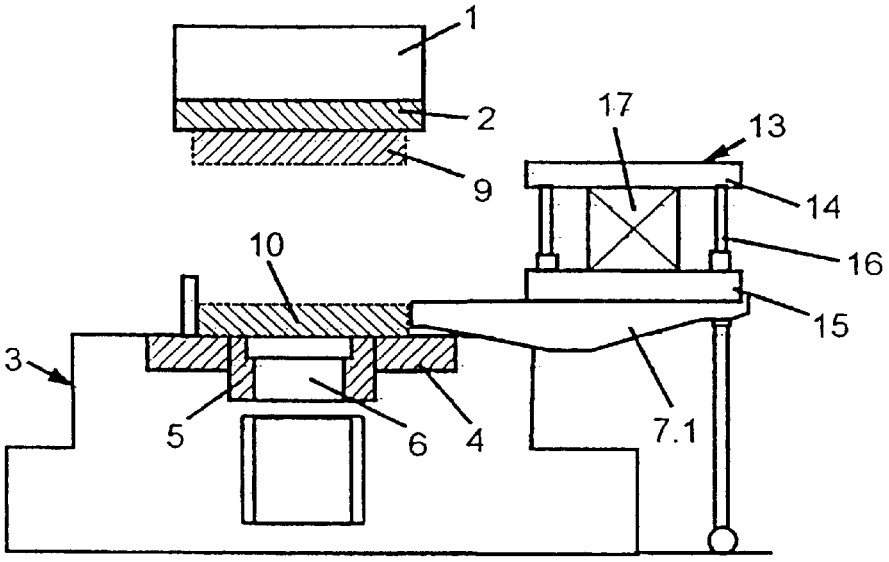
FIG. 3 shows a side view of the press in accordance with FIG. 1 in a further installed position.
Figure 4:
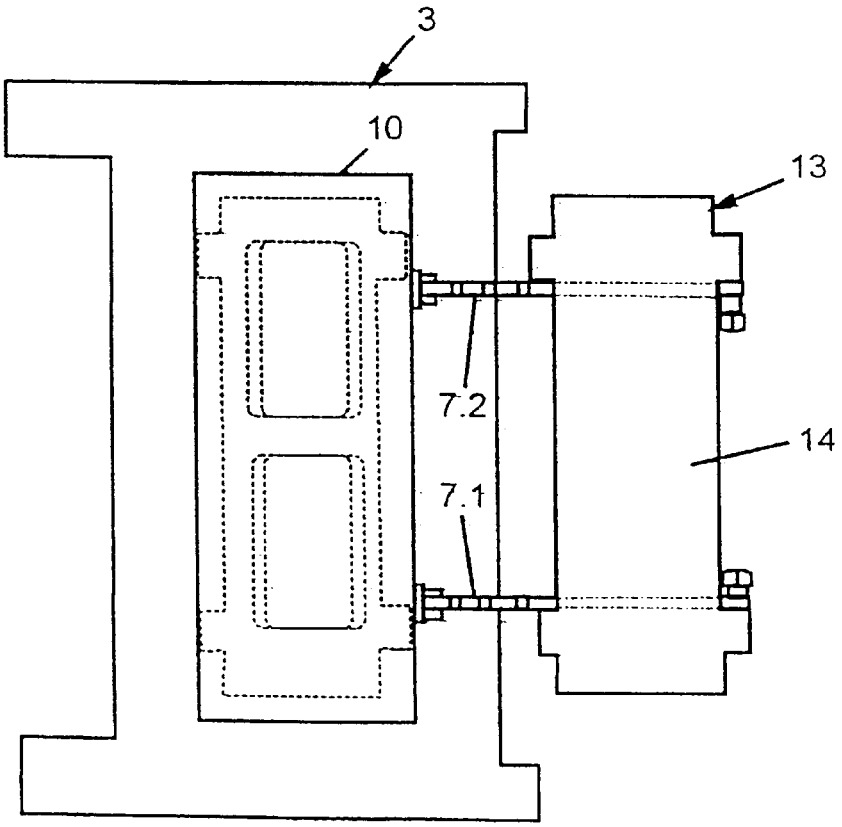
FIG. 4 shows a plan view of the press in accordance with FIG. 3 without a press upper part.

Moreover, two stops 12.1, 12.2 (see FIG. 2) can be seen on the lower table clamping surface 4, which stops serve to preposition the piece of additional hydraulic equipment Q.

After the two hydraulic plates 9 and 10 have been positioned in the press P, the supporting brackets 7.1 and 7.2 are turned over and their height is aligned so that a tool packet 13 can be introduced between the upper hydraulic plate 9 and lower hydraulic plate 10. Here, the tool packet 13 also rolls on the races 8 of the supporting brackets 7.1 and 7.2.

An upper tool plate 14 and a lower tool plate 15 are in turn separated from one another by means of built-in supports 16. The upper tool plate 14 is secured to the upper hydraulic plate 9 and the lower tool plate is secured to the lower hydraulic plate 10, which may in turn be carried out by means of the above-mentioned quick-release clamping devices. Then, the press is moved apart, i.e. the slide is raised so that the built-in supports 16 are released. Tools which interact are indicated schematically at 17.

Figure 5:
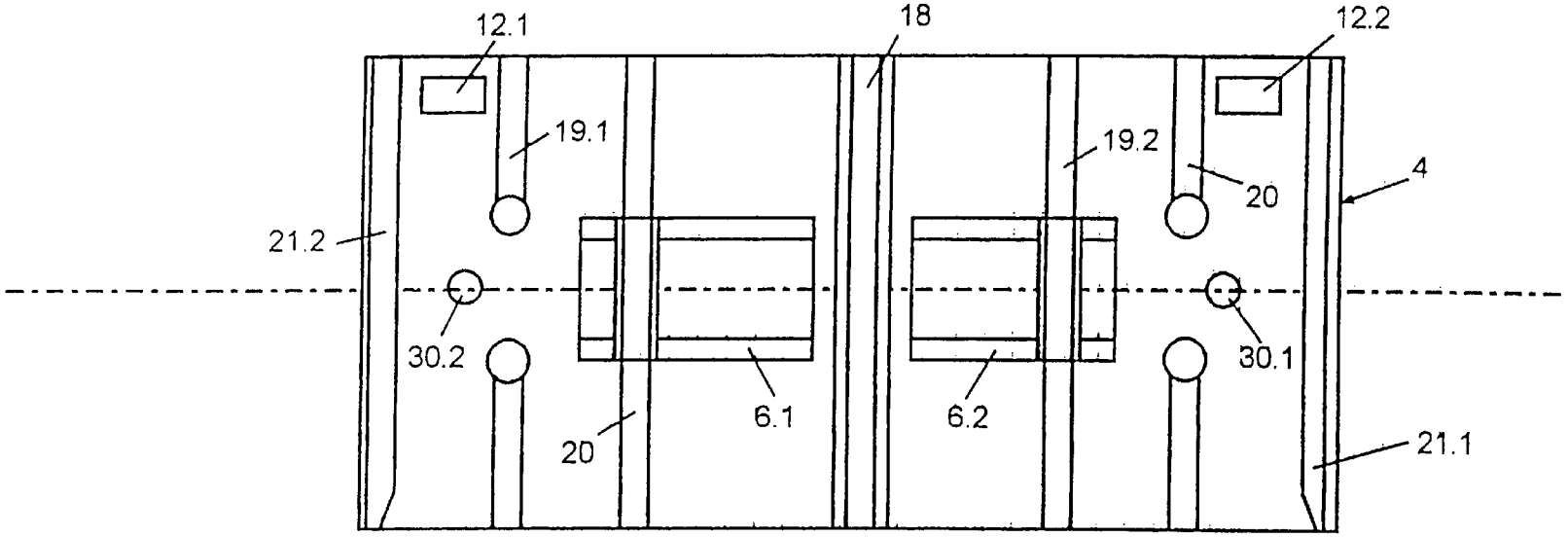
FIG. 5 shows a plan view of the press lower part 3 and/or table clamping surface.
Figure 6:
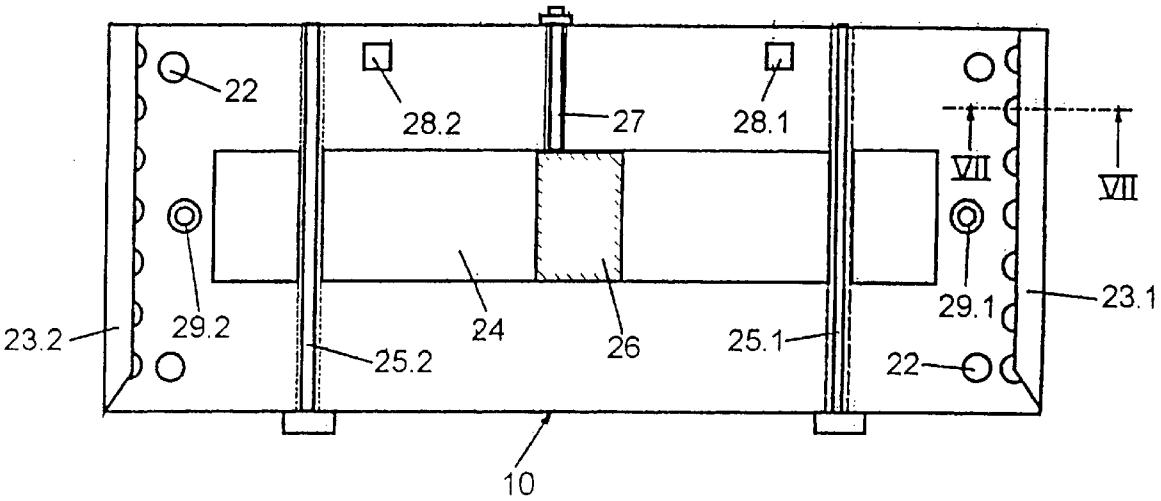
FIG. 6 shows a plan view of a lower hydraulic plate.

FIGS. 5 and 6 show the configuration of the table clamping surface 4 and the lower hydraulic plate 10 in more detail. The two stops 12.1 and 12.2 mentioned above are seated on the table clamping surface 4. Between the two stops 12.1 and 12.2 there is a push/pull chain 18 (indicated only schematically) with which the piece of additional hydraulic equipment Q can be pulled over the table clamping surface 4. Here, the lower hydraulic plate 10 rolls on two races 19.1 and 19.2 which are located in the table clamping surface 4 and also span the openings 6.1 and 6.2. At the same time, T bars (described in European Patent Application 86 81 01 76.7) engage in corresponding T grooves 20 which are used at a later time to secure the lower hydraulic plate 10 on the table clamping surface 4.

Further guidance of the lower hydraulic plate 10 is provided by means of lateral guide bars 21.1 and 2.2 which are arranged on the table clamping surface 4.

Figure 7:
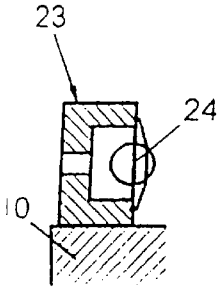
FIG. 7 shows a partial cross section through a ball raceway in accordance with FIG. 6 along line VII—VII.

FIG. 6 shows four drilled holes 22 in the lower hydraulic plate 10 in which the built-in supports 11 are plugged in the position of use. In addition, two ball raceways 23.1 and 23.2 are provided on the left and on the right and they are used for the later guidance of the tool packet 13. Such a ball raceway is shown in more detail in cross section in FIG. 7, one ball 24 being under the pressure of a corresponding pressure medium.

In addition, there is in the lower hydraulic plate 10 a rectangular recess 24 which is interrupted merely on both sides by means of one hydraulic roller block 25.1 and 25.2 in each case. This recess 24 is used for the insertion of hydraulic units 26 which are described later. The hydraulic unit 26 is supplied via a plug-in pipe 27 which is also described later. The hydraulic roller blocks 25.1 and 25.2 are configured in such a way that the tool packet 13 can be moved on them as far as stops 28.1 and 28.2 on the lower hydraulic plate 10. Since these hydraulic roller blocks are commercially available, a more detailed description will not be given. There are also hardened centering bushings 29.1 and 29.2 which are provided on both sides of the recess 24 in the lower hydraulic plate 10 and interact with preferably hydraulic centering bolts 30.1 and 30.2 in the table clamping surface 4. The lower hydraulic plate is positioned precisely by means of these hydraulic centering bolts 30.1 and 30.2 before the built-in supports 11 are removed.

The upper hydraulic plate, which is not shown in more detail, looks similar to the lower hydraulic plate 10, but is of significantly simpler design with respect to the positioning elements. It has merely the four drilled holes for receiving the built-in supports 11. In addition, it has a rectangular recess corresponding to the recess 24 into which corresponding upper hydraulic units or nitrogen units are inserted. Corresponding plug-in pipes then in turn lead to the latter. Essentially, the alignment of the upper hydraulic plate 9 is effected by means of these built-in supports 11.

Figure 8:
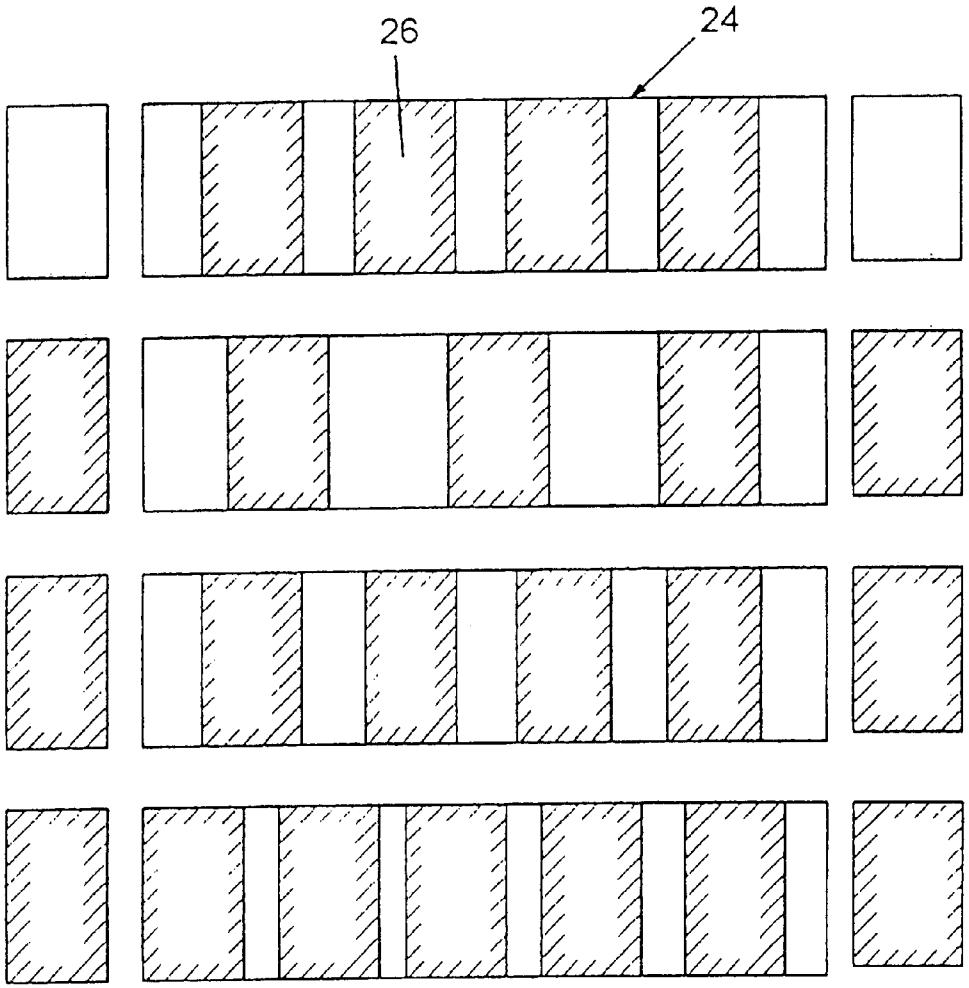

FIG. 8 shows various possible ways of arranging hydraulic units 26 and nitrogen units in the recess 24 in the upper and lower hydraulic plates 9 and 10. In FIG. 8*a* there are only four units 26 inserted, in FIG. 8*b* five units, in FIG. 8*c* six units and in FIG. 8*d* seven units. It is possible either to insert filler elements between them, which elements support the individual units 26 on one another or else open spaces may remain, through which punchings or the products of punching-out operations pass into the lower region of the machine and are moved away from there. In this way, a press is produced with individual or multistage tools. Any desired arrangement is possible.

Each unit 26 which is inserted into a recess 24 in the lower or upper hydraulic plates 10 and 9 has a working cylinder 30 in which a working piston 31 slides. These working cylinders 30 and working pistons 31 perform the inner tool functions of the press and/or its functions within the tool packet 13, such as for example provision of an abutment during precision blanking, stripping, ejection etc. This takes place outside the actual tool packet 13.

The working pistons 31 can be activated by means of pressurized oil, compressed air, nitrogen or by means of mechanical springs. In the preferred exemplary embodiment, pressurized oil is used. This pressurized oil is fed via the plug-in pipe 27 into the working cylinder 30.

32 designates drilled holes through which corresponding attachment means are inserted and by means of which the hydraulic unit 26 can be secured in the recess 24.

According to FIG. 11, all the plug-in pipes 27 are equipped with safety couplings 33 or safety diaphragms which prevent excess hydraulic pressure in the event of a hydraulic connection becoming inadvertently detached from the plug-in pipe 27, for example.

The various units 26 also include an appropriate mobile assembly by means of which the working cylinders 30 are supplied with pressurized oil, compressed air or nitrogen. This assembly is preferably an independent unit which is independent of the press.

In addition, a valve control block should be provided between the assembly and the corresponding connections of the units 26, it being possible for each working cylinder 30 in the individual units 26 to be set and regulated separately by means of said block. Each working cylinder 30 thus has its own control loop, it being possible to regulate the pressure/force adjustment in an infinitely adjustable fashion. This pressure is regulated in accordance with the functions of the units 26, any desired possibilities being conceivable here.

According to FIG. 12, a unit 26 which has two working cylinders 30.1 and 30.2 which are filled with nitrogen is inserted into a hydraulic plate 9/10. Two working pistons 31.1 and 31.2 are pressurized by means of the nitrogen, causing corresponding connection parts 34.1 and 34.2 in the tool plate 14/15 to be pressurized. These then transmit their movement and/or movement capability to a tool module 35.

FIGS. 13 and 14 indicate a table clamping surface 4 on which the lower hydraulic plate 10 with the recess 24 is seated. On this hydraulic plate 10 there is, in accordance with FIG. 14, the lower tool plate 15 and the tool module 35.1. Over the latter there hangs an upper tool module 35.2 on an upper tool plate 14 which is in turn attached to the upper hydraulic plate 9.

Punchings can drop past the side of the lower tool plate 15, the lower hydraulic plate 10 and the table clamping surface 4 or else drop through the recess 24 and/or the central opening 6 and pass along various baffle plates 36 to a conveyor 37.

What is claimed is:

1. A precision blanking press, comprising: a press upper part (1); a press lower part (3) associated with the press upper part (1); a tool (17) located between the press upper part (1) and press lower part (3); and an upper hydraulic plate (9) arranged between the tool and the press upper part (1) and a lower hydraulic plate (10) arranged between the tool and the press lower part (3), wherein the upper and a lower hydraulic plates (9, 10) are connected by means of built-in supports (11) to form a piece of additional hydraulic equipment (Q) wherein the supports are released from the plates by movement of the press upper part by means of quick release devices to form a space to receive a tool packet.

2. The press as claimed in claim 1, wherein the additional hydraulic equipment comprises a valve block and a mobile hydraulic assembly.

3. The press as claimed in claim 1, wherein an upper and a lower hydraulic plate (14, 15) are connected by means of built-in supports (16) to form the tool packet (13).

4. The press as claimed in claim 1, wherein at least one of the hydraulic plates (9, 10) has a recess (24) for receiving a hydraulic unit (26).

5. The press as claimed in claim 4, wherein the unit (26) has a working cylinder (30) in which a working piston (31) is arranged.

6. The press as claimed in claim 5, wherein a plug-in pipe (27) for feeding in a pressure medium opens into the working cylinder (30).

7. The press as claimed in claim 1, wherein the hydraulic plates (9, 10) are connected to the press upper part (1) and the press lower part (3) by means of quick-release clamping devices.

8. The press as claimed in claim 7, wherein a clamping surface (4) is arranged between the press upper part (1) and press lower part (3) and hydraulic plates (9, 10).

9. The press as claimed in claim 3, wherein the lower hydraulic plate (10) has lateral ball raceways (23) for guiding the lower hydraulic plate (15).

* * * * *